US006705960B2

(12) United States Patent
Gormley

(10) Patent No.: US 6,705,960 B2
(45) Date of Patent: Mar. 16, 2004

(54) TETHERBALL-TYPE GAME APPARATUS

(76) Inventor: Ian Gavin Gormley, 122 Lambert Road, Morningside, 4001 (ZA)

( * ) Notice: Subject to any disclaimer, the term of this patent is extended or adjusted under 35 U.S.C. 154(b) by 0 days.

(21) Appl. No.: 10/294,387

(22) Filed: Nov. 14, 2002

(65) Prior Publication Data

US 2003/0092511 A1 May 15, 2003

(30) Foreign Application Priority Data

Nov. 15, 2001 (ZA) ..... 2001/9434

(51) Int. Cl.[7] ..... A63B 43/02; A63B 67/00

(52) U.S. Cl. ..... 473/417; 473/423; 473/575; 473/614

(58) Field of Search ..... 473/417, 423, 473/429, 430, 575, 614, 576

(56) References Cited

U.S. PATENT DOCUMENTS

| | | | | | |
|---|---|---|---|---|---|
| 3,627,326 | A | * | 12/1971 | Berry | 473/200 |
| 3,959,060 | A | * | 5/1976 | Jones | 156/245 |
| 4,093,225 | A | * | 6/1978 | Oliver | 473/575 |
| 4,188,033 | A | * | 2/1980 | Wells | 473/575 |
| 4,294,447 | A | * | 10/1981 | Clark | 473/575 |
| 5,083,796 | A | * | 1/1992 | Norman | 473/575 |
| 5,577,732 | A | * | 11/1996 | Spector | 473/576 |
| 5,813,931 | A | * | 9/1998 | Gormley | 473/575 |
| 6,171,200 | B1 | * | 1/2001 | Camp | 473/249 |
| 6,328,665 | B1 | * | 12/2001 | Gormley | 473/423 |

FOREIGN PATENT DOCUMENTS

| | | |
|---|---|---|
| EP | 0 465 220 A1 | 1/1992 |
| EP | 0 819 451 A1 | 1/1998 |
| GB | 2 042 904 A | 10/1980 |

* cited by examiner

*Primary Examiner*—Gregory Vidovich
*Assistant Examiner*—Nini F. Legesse
(74) *Attorney, Agent, or Firm*—Dinsmore & Shohl LLP

(57) ABSTRACT

The invention relates to a tether cord and ball arrangement for a tether ball-type game apparatus. The arrangement comprises a cord, a ball engaged with the cord at one end thereof and a tail assembly. The tail assembly includes an elongate anchor element that defines an eye formation near one end thereof whereby the element can be rotatably located on the cord, particularly adjacent the location where the ball is engaged with the cord. The anchor element has a plurality of streamers attached thereto near its end opposite to the end where the eye formation is defined, the streamers, during play of a tether ball-type game which involves striking the ball with a bat, providing a pleasant visual and audible effect, while also providing for desired ball flight qualities.

12 Claims, 1 Drawing Sheet

TETHERBALL-TYPE GAME APPARATUS

A tetherball-type game apparatus, in use, comprises a pole, that is supported in an operatively upright configuration, and a cord having a ball engaged with one end thereof and having its opposite end engaged with the pole in a configuration in which the ball can be displaced in opposite directions around the pole by being struck by hand or foot, or with a suitable racquet, bat, paddle, or the like, hereinafter merely referred to as a bat. In a preferred embodiment the pole has a segment that defines a helical configuration and the cord has its one end engaged with this helical segment via a suitable engagement formation, the engagement formation typically comprising a loop formation provided at, or formed at, the said end of the cord. The helical segment serves to retain the cord at the level of the segment during displacement of the ball around the pole, while ensuring, in conjunction with the engagement formation of the cord, that the cord does not wind itself on the pole during said displacement of the ball.

The engagement between the cord and the ball of a tetherball-type game apparatus as above described permits free rotation of the ball about the cord where it is engaged with the cord, serving in effect to prevent twisting of the cord as a result of the ball being struck with over or under spin. The particular type of ball used and the size and mass of the ball used are variable, with both conventional tennis-type balls and foam-type balls having been used for the purpose.

Any reference hereinafter to a tether cord and ball arrangement for a tetherball-type game apparatus must be interpreted as a reference to a cord that has a ball engaged with one end thereof in the configuration described and that has, or can be provided with, an engagement formation, e.g. a loop formation, at the opposite end thereof, whereby the pole of the apparatus can be engaged by the cord.

The Applicant herein has proposed, in respect of the playing of tennis-type games, the use of a ball having a tail extending therefrom. The Applicant's U.S. Pat. No. 5,813,931 (assigned to European Sports Merchandising BV) discloses in particular a series of parameters for such a ball and for the tail of the ball, that will provide for desired bounce and flight qualities that will permit a tennis-type game to be played with such a ball. The beneficial effects of a tail being attached to a ball when playing a tennis-type game include "slowing down" of the ball when in flight, while a more regular flight path for the ball also is provided for. By slowing down the ball, the distance that the ball can travel is reduced and, as such, the size of a playing area or court can be reduced, the combined effect including that playing of such a game is made easier while enjoyment is not reduced, particularly insofar as the ball can still be struck at "full strength" by a player. The visual and audible effects that can be created by a tail also can render playing of such a game more pleasing.

It is thus an object of this invention to link the above described beneficial effects associated with a ball and tail combination, in the playing of a tennis-type game, with a tetherball-type game. However, merely attaching a tail to the ball of a tether cord and ball arrangement, has not proved to be practical, particularly insofar as the tail tends to tangle with the ball and the cord as it repeatedly changes direction when struck. Such tangling of the tail with the ball, in addition to interfering with the flight path and flight characteristics of the ball to the detriment of the game, also results in the tail being destroyed very quickly, particularly due to being repeatedly struck with a bat.

The ball and tail combination disclosed in the Applicant's U.S. Pat. No. 5,813,931, which is referred to above, therefore is not suitable for use in a tetherball-type game. Details of all other prior art ball and tail combinations of which the Applicant is aware are set out in column 2, lines 10 to 67 and column 3, lines 1 to 30, of the specification as filed in support of the above patent and for the reasons explained therein, also cannot be suitable for use in a tetherball-type game.

As such, it is a further object of this invention to at least ameliorate the above problems associated with the attachment of a tail to the ball of a tether cord and ball arrangement while still benefitting from the beneficial effects associated with a ball and tail combination as above envisaged.

Within this specification, in relation to the definition of certain components of the invention, reference is made to a flexibility rating that identifies the actual and relative flexibility of these components. The procedure whereby this rating is established, as outlined in the Applicant's U.S. Pat. No. 5,813,931, constitutes a comparative procedure with the flexibility rating of a component being the distance in millimeters whereby the component can be horizontally displaced beyond the edge of a horizontal support surface before the projecting segment of the component has bent downwards, under the force of gravity, to the extent that the leading end of the component subtends at an angle of 45° to the plane of the horizontal support surface. By way of explanation, therefore, a very flexible component can only be displaced a relatively short distance beyond the edge of a support surface before its leading end subtends at the angle of 45° to the plane of the support surface, thus having a low flexibility rating, whereas a more rigid component can be displaced a longer distance beyond said edge, thus having a higher flexibility rating. The above procedure for establishing a flexibility rating is illustrated with reference to FIGS. 5 and 6 of Applicant's U.S. Pat. No. 5,813,931 and clearly allows for an accurate, measurable and simple comparative test whereby the flexibility of components can be compared and rated, without attempting to define the flexibility of a component on an absolute scale.

SUMMARY OF THE INVENTION

According to the invention there is provided a tether cord and ball arrangement for a tether ball-type game apparatus, which comprises a cord, a ball engaged with the cord at one end thereof and a tail assembly, in which the tail assembly includes an elongate anchor element having a length of at least 50 mm and defining an eye formation near one end thereof, whereby the element is located on the cord in a configuration in which it is free to rotate about the cord, and a streamer attachment location near the other end of the element, the anchor element having a flexibility rating of at least 200 mm; and at least one elongate streamer of a thin flexible material that has a flexibility rating between 20 mm and 100 mm, a thickness less than 0.1 mm and a length not shorter than three times the diameter of the ball and not longer than approximately 2000 mm, one end of the streamer being attached to the anchor element in a configuration in which it extends from the anchor element at the said streamer attachment location thereof, and in which the total weight of the tail assembly is not more than 20% of the weight of the ball.

The streamer of the tail assembly preferably has a thickness less than 0.06 mm and preferably is formed of a synthetic plastics sheet material.

Further according to the invention, the tail assembly may include a plurality of streamers that are attached to the anchor element in a configuration in which they extend from the anchor element at the said attachment location thereof.

The anchor element of the tether cord and ball arrangement of the invention may have an eye formation that can open and close for locating the anchor element on the cord. Also, the eye formation defined near one end of the anchor element and the attachment location defined near the other end of the anchor element may be at least 150 mm apart.

The anchor element preferably has a flexibility rating of approximately 350 mm, the anchor element preferably comprising an elongate, slender, synthetic plastics element.

The ball of the tether cord and ball arrangement of the invention may have a diameter between 50 mm and 100 mm and may have a mass of between 10 g and 90 g.

The invention extends also to a tether ball-type apparatus which comprises a pole, that can be supported in an operative upright configuration, and a tether cord and ball arrangement which comprises a cord, a ball engaged with the cord at one end thereof and a tail assembly, in which the tail assembly includes an elongate anchor element having a length of at least 50 mm and defining a eye formation near one end thereof, whereby the element is located on the cord in a configuration in which it is free to rotate about the cord and a streamer attachment location near the other end of the element, the anchor element having a flexibility rating of at least 200 mm; and at least one elongate streamer of a flexible material that has a flexibility rating between 20 mm and 100 mm, a thickness less than 0.1 metres and a length not shorter than three times the diameter of the ball and not longer than approximately 2000 mm, one end of the streamer being attached to the anchor element in a configuration in which it extends from the anchor element at the said streamer attachment location thereof, and in which the tail assembly has a total weight that is not more than 20% of the weight of the ball.

The tail assembly forming part of the tether cord and ball arrangement of the tether ball-type apparatus of the invention particularly may include all the features of the tail assembly of the tether cord and ball arrangement, in accordance with the invention.

The invention extends still further to a tail assembly of a tether cord and ball arrangement for a tether ball-type game apparatus, which tail assembly includes an elongate anchor element having a length of at least 50 mm and defining an eye formation near one end thereof, whereby the element can be located on the cord of a tether cord and ball arrangement in a configuration in which it is free to rotate about the cord, and a streamer attachment location near the other end of the element, the anchor element having a flexibility rating of at least 200 mm; and at least one elongate streamer of a thin flexible material that has a flexibility rating between 20 mm and 100 mm, a thickness less than 0.1 mm and a length not shorter than three times the diameter of the ball of a tether cord and ball arrangement with which the tail assembly is to be used and not longer than approximately 2000 mm, one end of the streamer being attached to the anchor element in a configuration in which it extends from the anchor element at the said streamer attachment location thereof, and in which the total weight of the tail assembly is not more than 20% of the weight of the ball of a tether cord and ball arrangement with which the tail assembly is to be used.

BRIEF DESCRIPTION OF THE DRAWINGS

Further features of the tether cord and ball arrangement, in accordance with the invention, and the benefits associated with the use thereof in conjunction with a tether ball-type game apparatus, are described in more detail hereafter, with reference to an example of the invention illustrated in the accompanying diagrammatic drawings. In the drawings.

DETAILED DESCRIPTION

Figure 1:
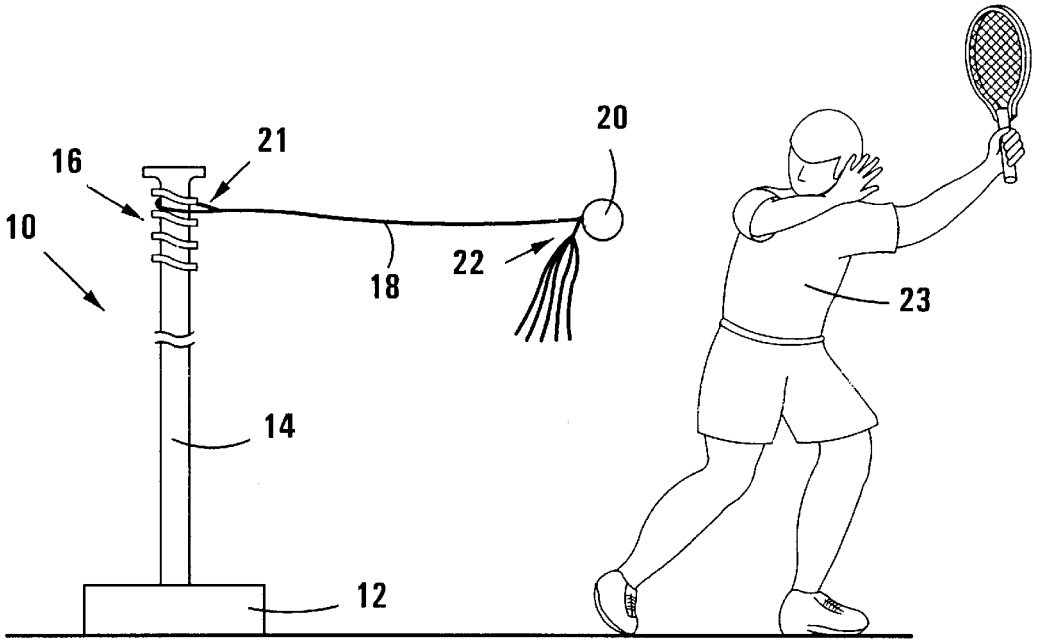
FIG. 1 shows a schematic side view of a tether ball-type game apparatus which includes a tether ball and cord arrangement, in accordance with the invention.

Referring initially to FIG. 1 of the drawings, a tether ball-type game apparatus which includes a tether cord and ball arrangement, in accordance with the invention, is designated generally by the reference numeral 10. The apparatus 10 includes a base member 12 positionable on a ground surface and an upright pole 14 held in its upright configuration by the base member. The upright pole 14 has a segment 16 that defines a helical configuration, near the operative top end thereof, as shown.

The apparatus 10 includes also a cord 18 that has a ball engaged with one end thereof in a conventional manner, the opposite end of the cord being provided with an engagement formation in the form of a loop formation 21, whereby the segment 16 of the pole 14 is engaged in the configuration as shown.

A tail assembly 22 is located on the cord 18 and by the displacement of the ball 20 in a usual tether ball game fashion, the tail part of the tail assembly will trail behind the ball 20, as is described in more detail hereafter. The positioning of a player 23 with respect to the apparatus 10, in order to play a tether ball game, is illustrated also in FIG. 1. Clearly, the game can be played by two players also, with the players being positioned in opposite locations with respect to the upright pole 14 of the apparatus.

The overall configuration of the apparatus 10, except for the tail assembly 22, is essentially conventional and, as such, is not described in further detail herein. It will be appreciated in this regard that different configurations apparatus of the type are known and that the apparatus may be associated with different types of balls, including conventional tennis-type balls, foam-type balls, and the like.

Figure 2:
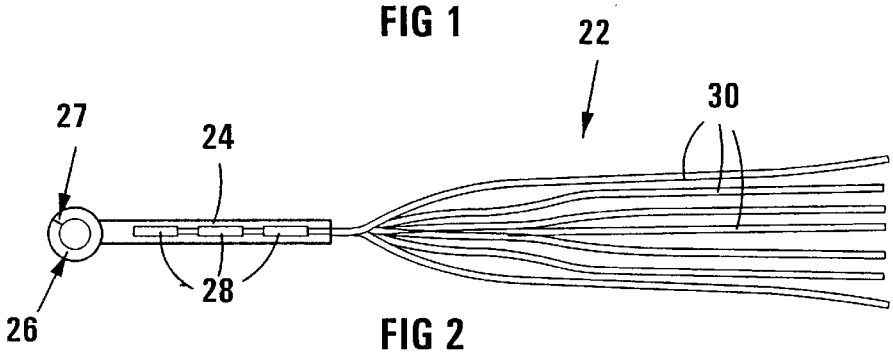
FIG. 2 illustrates the tail assembly of a tether cord and ball arrangement, in accordance with the invention.
Figure 3:
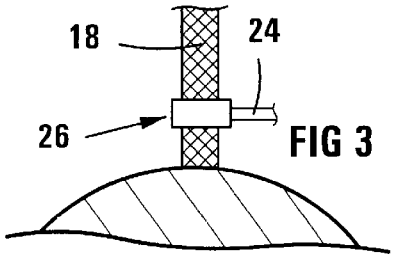
FIG. 3 illustrates the location of the tail assembly on a tether cord.
Figure 4:
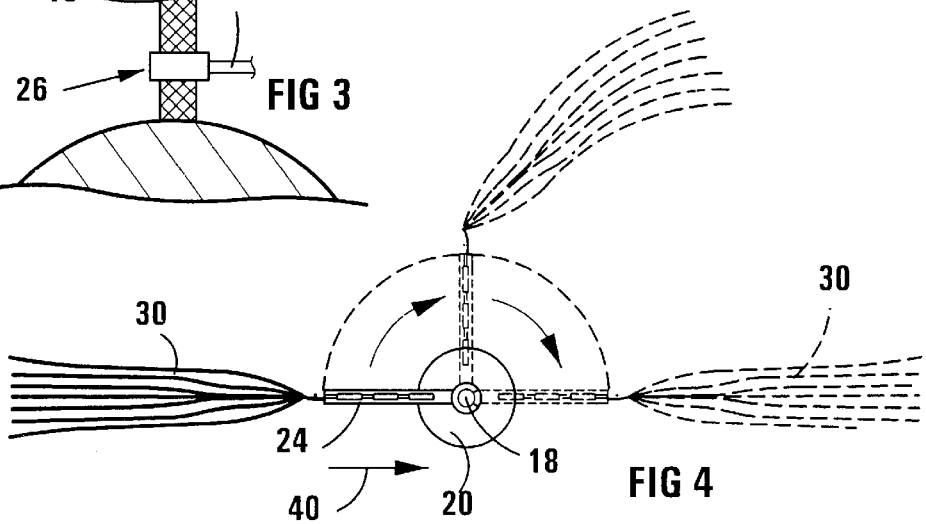
FIG. 4 illustrates the displacement of the tail assembly with respect to a tether cord during play of a game with the apparatus as shown in FIG. 1.

Referring also to FIGS. 2 to 4 of the drawings, the tail assembly comprises an anchoring formation in the form of an anchor element 24, the anchor element comprising an elongate, slender, synthetic plastics element that has a flexibility rating of approximately 350 mm, which renders it effectively semi-flexible.

The anchor element 24 defines an eye formation 26 at one end thereof and three slots 28 at spaced locations along the length thereof, with the slot 28 remote from the eye formation 26 being disposed near the end of the element 24 opposite to the end where the eye formation 26 is defined. Tail elements in the form of elongate streamers 30, of a suitable synthetic plastics material having a thickness less than 0.06 mm and a flexibility rating between 20 mm and 100 mm, are attached to the anchor element by being threaded through the slots 28, the streamers thereby being securely located with respect to the anchor element 24 and extending effectively from a streamer attachment location defined near the end of the anchor element opposite to the end where the eye formation 26 is defined.

The exact configuration of the tail assembly 22 and, particularly, of the anchor element 24 and the streamers 30, is greatly variable, while it can still incorporate the essential features of the assembly which provide for an anchor element defining an eye formation near one end thereof and a location near the opposite end thereof where streamers extend from the anchor element. The spacing between the eye formation 26 and the said location where the streamers extend from the anchor element preferably is in the order of 150 mm.

As shown in FIG. 3 of the drawings, the eye formation 26 provides for the location of the anchor element 24 on the cord of the apparatus 10, the eye formation permitting free rotation of the anchor element about the cord, while playing a tether ball game. It must be understood that the configuration of the eye formation is greatly variable and particularly that the eye formation may be provided in an openable form that can facilitate the location of the anchor element 24 on the cord 18. The eye formation as shown defines a slit 27 that permits opening of the eye formation by the resilient deformation of the eye segments on opposite sides of the slit.

Referring particularly to FIG. 4 of the drawings, while playing a tether ball game and with the ball 20 travelling in the direction of arrow 40, centrifugal forces acting on the tail assembly will provide for the assembly to be disposed immediately adjacent the ball, while the streamers will trail the ball 20 as shown. When the direction of travel of the ball is reversed by being struck with a bat, the anchor element 24 will rotate about the cord 18 as illustrated, whereafter the streamers 30 will trail in an opposite direction behind the ball 20.

The path of displacement of the anchor element 24 serves in effect to protect the streamers 30 against a substantially instantaneous reversal of travel direction after the direction of travel of the associated ball is reversed, where such instantaneous reversal will result in undue wear on the streamers and in the streamers thus having a limited life span. The anchor element thus serves to extend the life of the streamers.

The tail assembly 22 of the apparatus 10 and, particularly, the streamers 30, serve to slow the speed of travel of the ball 20 when playing a game, which will make playing of the game somewhat easier, particularly for smaller children.

Insofar as the ball 20 may have a diameter between 50 mm and 100 mm and a mass between 10 g and 90 g, it must be understood that by providing for balls of different diameters and mass, play of the tether ball game can be rendered particularly suitable for people of different sizes and ages, particularly by taking into account the characteristics imparted on the ball by the location of the tail assembly 22 on the cord to which the ball is engaged. Another consideration in this regard will be that the total weight of the tail assembly will not be more than 20% of the weight of the ball, in order to ensure that the flight characteristics of the ball having been struck with a bat are not unduly affected by the tail assembly.

The streamers 30 also will make it easy to follow the path of travel of the ball 20, thus further facilitating playing of the game. It is believed also that the rustling noise effect and visual fluttering or movement effect of the streamers during play of a game will enhance the attractiveness associated with play of the game, particularly when combined with the visual effect created by the streamers 30. It is envisaged that various different configuration tail assemblies can be provided, with the anchor elements of such assemblies being of variable length and the streamers of such assemblies being variable in length, width, thickness, flexibility and number. Streamers can thus be provided also of different materials that are formed into elongate strips to effectively form streamers.

The above parameters clearly can determine the characteristics of a tail assembly and can provide desired qualities, particularly in relation to the flight characteristics of the ball with which the tail assembly is to be associated.

The invention extends also to these tail assemblies as such, as well as to the various different configuration tether cord and ball arrangements, including such tail assemblies.

What is claimed is:

1. A tether cord and ball arrangement for a tether ball-type game apparatus, including a cord, a ball engaged with the cord at one end thereof and a tail assembly, wherein said tail assembly comprises:

an elongate anchor element located on said cord so that said elongate anchor element can rotate about said cord, said elongate anchor element comprising:
a first end and a second end,
an eye formation located near said first end, and
a streamer attachment located near said second end,
wherein said element has a length of at least 50 mm and a flexibility rating of at least 200 mm; and at least one elongate streamer comprising a thin flexible material having a flexibility rating between 20 mm and 100 mm, a thickness less than 0.1 mm and a length not shorter than three times the diameter of the ball and not longer than approximately 2000 mm, wherein said streamer is attached to said elongate anchor element at a location so that said streamer extends from said elongate anchor element at said location, wherein the total weight of the tail assembly is not more than 20% of the weight of the ball.

2. An arrangement as claimed in claim 1, wherein said streamer has a thickness less than 0.06 mm.

3. An arrangement as claimed in claim 1, wherein said streamer comprises a synthetic plastics sheet material.

4. An arrangement as claimed in claim 1, wherein said tail assembly comprises a plurality of streamers that are attached to said elongate anchor element at a location so that said plurality of streamers extend from said elongate anchor element at said location.

5. An arrangement as claimed in claim 1, wherein said eye formation can open and close for locating said elongate anchor element on said cord.

6. An arrangement as claimed in claim 1, wherein said eye formation and said streamer attachment location are at least 150 mm apart.

7. An arrangement as claimed in claim 1, wherein said elongation anchor element has a flexibility rating of approximately 350 mm.

8. An arrangement as claimed in claim 1, wherein said anchor element comprises an elongate, slender, synthetic plastics element.

9. An arrangement as claimed in claim 1, wherein said ball has a diameter of between 50 mm and 100 mm.

10. An arrangement as claimed in claim 1, wherein said ball has a mass of between 10 g and 90 g.

11. A tether ball-type apparatus comprising a pole, that can be supported in an operative upright configuration, and a tether cord and ball arrangement comprising a cord, a ball engaged with the cord at one end thereof and a tail assembly, in which the tail assembly comprising:

an elongate anchor element located on said cord so that said elongate anchor element can rotate about said cord, said elongate anchor element comprising:
a first end and a second end,
an eye formation located near said first end, and
a streamer attachment located near said second end,
wherein said element has a length of at least 50 mm and a flexibility rating of at least 200 mm; and at least one elongate streamer comprising a thin flexible material having a flexibility rating between 20 mm and 100 mm, a thickness less than 0.1 mm and a length not shorter than three times the diameter of the ball and not longer than approximately 2000 mm, wherein said streamer is attached to said elongate anchor element at a location so that said streamer extends from said elongate anchor element at said location, wherein the total weight of the tail assembly is not more than 20% of the weight of the ball.

12. A tail assembly for a tether cord and ball arrangement for a tether ball-type apparatus comprising:

an elongate anchor element located on said cord so that said elongate anchor element can rotate about said cord, said elongate anchor element comprising:

a first end and a second end, an eye formation located near said first end, and a streamer attachment located near said second end, wherein said element has a length of at least 50 mm and a flexibility rating of at least 200 mm; and at least one elongate streamer comprising a thin flexible material having a flexibility rating between 20 mm and 100 mm, a thickness less than 0.1 mm and a length not shorter than three times the diameter of the ball and not longer than approximately 2000 mm, wherein said streamer is attached to said elongate anchor element at a location so that said streamer extends from said elongate anchor element at said location, wherein the total weight of the tail assembly is not more than 20% of the weight of the ball.

* * * * *